US006308702B1

(12) United States Patent
Huyghe et al.

(10) Patent No.: US 6,308,702 B1
(45) Date of Patent: Oct. 30, 2001

(54) COMPACT HIGH-EFFICIENCY AIR HEATER

(75) Inventors: Paul H. J. Huyghe, Varsenare; Hans Dewolf, Hamme, both of (BE)

(73) Assignee: Thomas & Betts International, Inc., NV (US)

( * ) Notice: Subject to any disclaimer, the term of this patent is extended or adjusted under 35 U.S.C. 154(b) by 0 days.

(21) Appl. No.: 09/580,381

(22) Filed: May 26, 2000

Related U.S. Application Data

(60) Provisional application No. 60/161,723, filed on May 27, 1999.

(51) Int. Cl.[7] ..... F24H 3/12

(52) U.S. Cl. ..... 126/110 B; 126/116 A; 165/96; 165/134.1; 236/11; 236/91 F

(58) Field of Search ..... 126/110 B, 110 D, 126/116 A, 116 R, 116 B, 104 R, 104 A; 239/566, 553.3, 553.5; 236/11, 91 F, 91 E, 9 A, 49.3; 165/134.1, 166, 146, 96

(56) References Cited

U.S. PATENT DOCUMENTS

| | | | | |
|---|---|---|---|---|
| 1,873,570 | * | 8/1932 | Frantz | 126/116 R |
| 2,173,280 | * | 9/1939 | Le Tourneau | 126/110 R |

(List continued on next page.)

FOREIGN PATENT DOCUMENTS

| | | | |
|---|---|---|---|
| 658844 | * | 3/1963 | (CA) ..... 126/110 R |
| 109057 | | 3/1900 | (DE) . |
| 741629 | | 11/1943 | (DE) . |
| 998449 | | 1/1952 | (FR) . |
| 13900 | | 6/1904 | (GB) . |
| 60-80094 | | 5/1985 | (JP) . |
| 60-185095 | | 9/1985 | (JP) . |
| 4-208395 | | 7/1992 | (JP) . |
| 1291-812-A | | 2/1987 | (SU) . |

OTHER PUBLICATIONS

Reznor®—Nieuw concept luchtverwrmer versterkt de voordelen en beperkt de nadelen, Jan. 1998.
Mikpunt—Algement Tevredenheid over VSK '98, Apr. 1998.

*Primary Examiner*—Ira S. Lazarus
*Assistant Examiner*—Sara Clarke
(74) *Attorney, Agent, or Firm*—Hoffmann & Baron, LLP

(57) ABSTRACT

A compact high efficient air heater providing improved comfort regulation. The air heater includes a cross-flow type heat exchanger formed from a plurality of stacked corrugated plates which define a plurality of alternating flue gas passages and air passages, and which include a plurality of modified air passages which provide increased air flow through the heat exchanger along the flue gas inlet side whereby increased heat transfer along the flue gas inlet side is accomplished. The air heater also includes a plurality of bypass channels which direct air flow across at least one surface of the combustion chamber to remove heat from the combustion chamber housing, to lower the temperature of the flue gases entering the heat exchanger, and to reduce the temperature gradient at the air outlet side of the heat exchanger.

41 Claims, 18 Drawing Sheets

U.S. PATENT DOCUMENTS

| | | | | |
|---|---|---|---|---|
| 2,246,329 | | 7/1941 | Telkes . | |
| 2,494,243 | * | 1/1950 | Houlis | 239/553.3 |
| 3,481,321 | | 12/1969 | Reichelderfer . | |
| 3,709,473 | | 1/1973 | Ito et al. . | |
| 3,912,162 | | 10/1975 | Bauer et al. . | |
| 4,006,728 | * | 2/1977 | Nishi et al. | 126/110 R |
| 4,044,950 | | 8/1977 | Engeling et al. . | |
| 4,140,274 | | 2/1979 | Nabinger . | |
| 4,175,699 | | 11/1979 | Engeling et al. . | |
| 4,288,218 | | 9/1981 | Obinata . | |
| 4,309,978 | | 1/1982 | Hensiek et al. . | |
| 4,327,802 | | 5/1982 | Beldam . | |
| 4,537,345 | | 8/1985 | Brown . | |
| 4,548,355 | | 10/1985 | Stolz et al. . | |
| 4,579,163 | * | 4/1986 | Maendel | 165/166 |
| 4,605,060 | | 8/1986 | Andersson et al. . | |
| 4,628,798 | | 12/1986 | Tagnon . | |
| 4,688,631 | | 8/1987 | Peze et al. . | |
| 4,712,611 | * | 12/1987 | Witzel | 165/903 |
| 4,815,524 | | 3/1989 | Dempsey et al. . | |
| 4,848,313 | | 7/1989 | Velie . | |
| 4,926,839 | | 5/1990 | Sugawara et al. . | |
| 5,197,664 | | 3/1993 | Lynch . | |
| 5,209,398 | | 5/1993 | Drees . | |
| 5,295,473 | | 3/1994 | Neufeldt . | |
| 5,326,026 | | 7/1994 | Jefferson et al. . | |
| 5,367,601 | | 11/1994 | Hannabery . | |
| 5,590,642 | | 1/1997 | Borgeson et al. . | |
| 5,709,264 | | 1/1998 | Sweeney et al. . | |
| 5,865,618 | | 2/1999 | Hiebert . | |

* cited by examiner

10

COMPACT HIGH-EFFICIENCY AIR HEATER

This application claims the benefit of U.S. Provisional Application Serial No. 60/161,723 filed May 27, 1999.

BACKGROUND OF THE INVENTION

The present invention relates to a heater and, more particularly, to a compact high-efficient air heater.

Prior art air heaters typically include both a heating section and a blower unit, which blows the cool air to be heated through the heating section and thereafter distributes the heated air into a room. The heating section includes both a combustion chamber in which a combustible fuel is burned to produce hot combustion product gases (commonly referred to as flue gases), and a heat exchanger through which the flue gases are directed. The cool air to be heated is simultaneously directed through the heat exchanger whereby the heat from the hot flue gases is transferred via the heat exchanger to the cool air. The heated air is then directed into the room. Thus, the mentioned heater not only heats the air, but also distributes the heated air into the room.

This same air heater is typically utilized as a "stand alone" unit, and is often mounted at an elevated location, e.g., it may be suspended from the ceiling of a room. Thus, the heated air exiting the heater must not only be blown out from the heater, but must also be directed downwards into the room. It will be recognized that stratification (i.e., the tendency of warm air to rise within a room) is a condition which must be specifically addressed, particularly since the heater may already be positioned at an elevated location.

In certain prior art applications, one or more ceiling fans may be installed in the room to move the heated air downward and reduce stratification. These ceiling fans are typically controlled by a thermostat independent of the heater. Thus, in the past, the condition of stratification has been addressed independently of the operation of the heater often leading to inefficient operation of the heater and uncomfortable temperature swings.

Next, typical prior art heaters utilize cross-flow heat exchangers wherein the flue gases are directed through a first set of passages in the heat exchanger, while the cool air to be heated is directed crosswise through a second set of passages in the heat exchanger which alternate with the first set of passages whereby the heat from the hot flue gases is transferred through the metal components of the heat exchanger to the cool air. It will be appreciated that the mass flow of cool air through the heat exchanger of an air heater is significantly greater than the mass flow of hot flue gases through the same heat exchanger. The ratio of the mass flow of the cool air to the flue gases typically ranges from 25:1 to 250:1. To facilitate this unequal flow of fluids, typically prior art heat exchangers require the necessity of a larger blower unit (which translates into higher energy costs) and/or require an increase in the size of the heat exchanger (thus increasing the overall size of the heater).

It will be recognized by those skilled in the art that prior art heaters utilizing only a single stage heat exchanger typically exhibit 78 to 80% thermal efficiency. When higher efficiency is desired, prior art heaters must add a second heat exchanger, which further cools the flue gases (typically to a point below the dew point) whereby a thermal efficiency of 90% plus can be achieved. The addition of a second heat exchanger, however, increases the cost and/or the overall size of the heater.

It will also be appreciated that prior art cross-flow heat exchangers typically exhibit an unwanted "temperature gradient" along the air outlet side of the heat exchanger. Stated differently, the surface of the heat exchanger through which the heated air exits will exhibit a temperature gradient wherein the portion of such surface closest to the flue gas inlet is significantly hotter than the portion of such surface proximate the flue gas outlet. Because the air exiting the heat exchanger exhibits this temperature gradient, heating a room becomes more difficult and the comfort of the persons working within the room may be affected.

It will be further appreciated that the portion of the heat exchanger proximate the combustion chamber is exposed to very high temperatures. Prior art heaters typically address the exposure to these high temperatures through the use of high temperature resistant materials, insulation, and/or certain design criteria, e.g., increased size of the unit.

Those skilled in the art will also recognize that condensation occurs within the flue gas passages during the heat transfer process, and that this condensation must be removed from the heat exchanger. It will be further appreciated by those skilled in the art that different heating environments may require significantly different sized heaters. Prior art heaters are not typically designed to be modular in concept, and thus are not readily adapted to such different heating requirements.

There is therefore a need in the art for a compact air heater which exhibits a high efficiency (preferably through cooling of the flue gases below the dew point) even in a one stage construction, provides for ready removal of condensation from the flue gas passages, facilitates unequal mass flows of fluids through the heat exchanger without requiring an increase in overall size of the heat exchanger and/or an increase in the size of the fan/blower, reduces the temperature gradient along the air outlet side of the heat exchanger, reduces the tendency of the air in the room to stratify, provides improved comfort regulation, and provides a design which is modular in concept thus allowing the heater unit to be more specifically designed for a particular heating application.

SUMMARY OF THE INVENTION

The present invention, which addresses the needs of the prior art, relates to an air heater. The air heater includes a burner for burning a combustible fuel to provide flue gases. The air heater further includes a combustion chamber surrounding the burner. The air heater further includes a cross-flow heat exchanger including an assembly of stacked corrugated plates which together define a plurality of alternating flue gas passages and air passages and which also define an air inlet side, an air outlet side, a flue gas inlet side and a flue gas outlet side. The air heater further includes a housing for surrounding and supporting the heat exchanger and having an air inlet and air outlet. The air heater further includes a fan for moving air through the housing and through the air passages of the heat exchanger. The combustion chamber communicates with the flue gas inlet side of the heat exchange to direct the flue gases through the flue gas passages. Finally, each of the plates includes a non-corrugated region proximate the flue gas inlet side of the heat exchanger thereby defining a plurality of modified air passages which provide increased air flow through the heat exchanger along the flue gas inlet side whereby increased heat transfer along the flue gas inlet side is accomplished.

As a result, the present invention provides a compact air heater which exhibits a high efficiency while utilizing a one stage construction, provides for ready removal of condensation from the flue gas passages, facilitates unequal mass flows of fluid through the heat exchanger without requiring an increase in overall size of the heat exchanger and/or an increase in the size of the blower, reduces the temperature gradient along the outlet surface of the heat exchanger, reduces the tendency of the air in the room to stratify, provides improved comfort regulation and provides a design which is modular in concept thus allowing the heater to be more specifically designed for particular heating application.

DETAILED DESCRIPTION OF THE INVENTION

Figure 1:
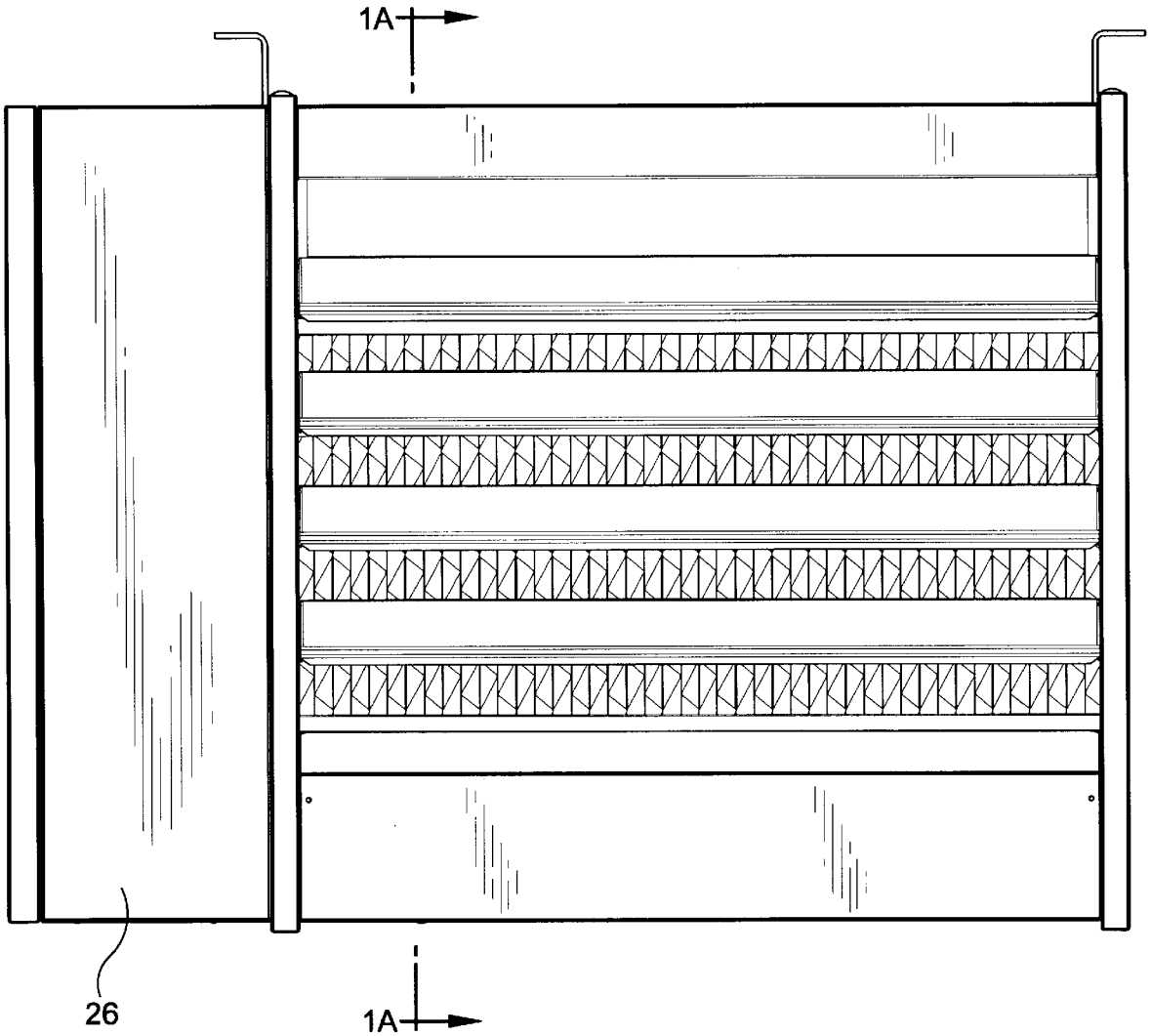
FIG. 1 is a front elevational view of a heater in accordance with the present invention.
Figure 1A:
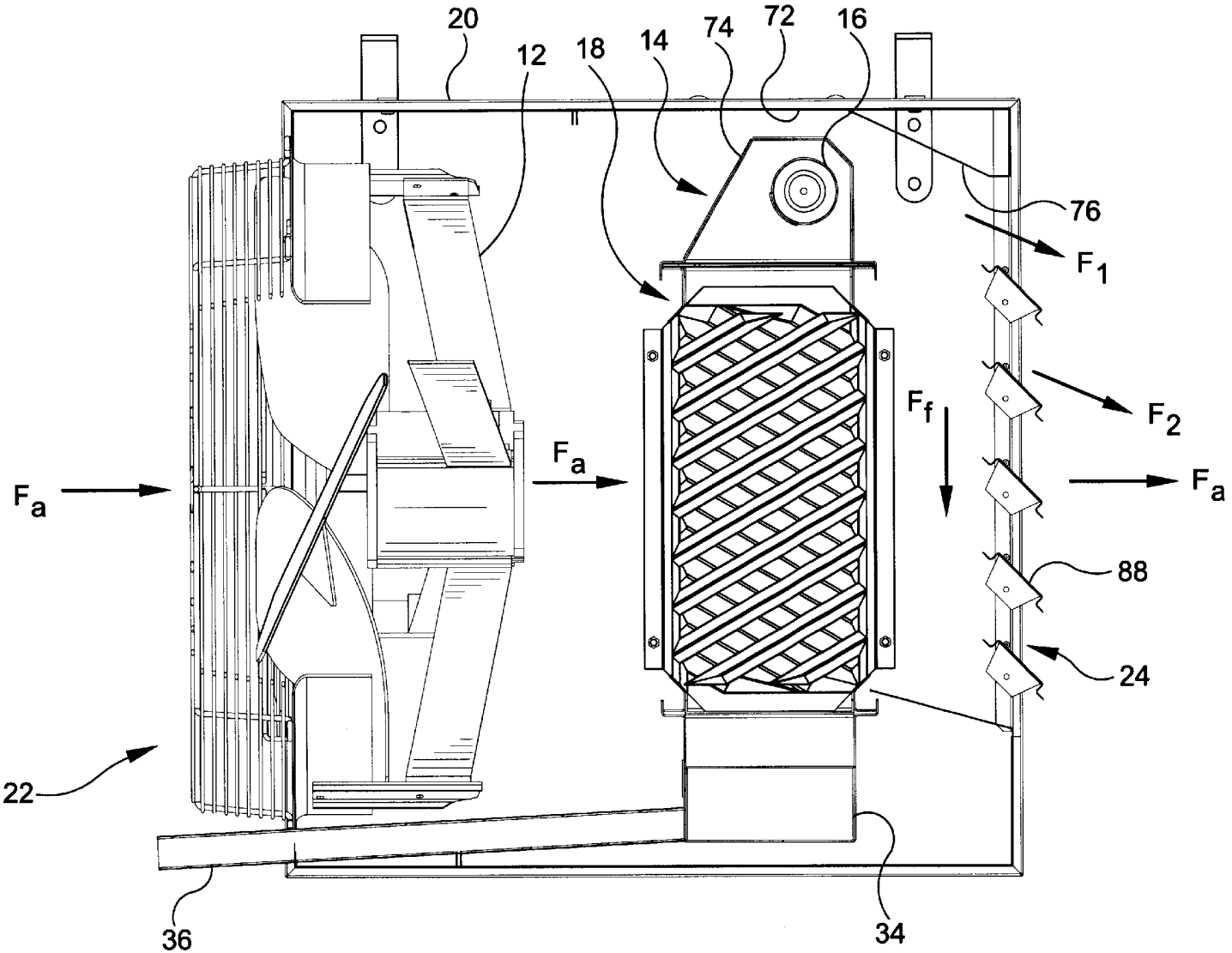
FIG. 1A is a sectional view taken along lines 1A—1A of FIG. 1.

Referring now to the drawings, a heater 10 in accordance with the present invention is shown in FIGS. 1 and 1A. Heater 10 includes a blower, i.e., internal fan 12, a combustion chamber 14 having a burner 16 located therein and a heat exchanger 18. Heater 10 further includes a housing 20 which surrounds and supports the fan, combustion chamber and heat exchanger. Housing 20 includes an air entrance 22 which allows cool air to be drawn into the heater by fan 12, and an air exit 24 which allows heated air to be blown out of the heater by fan 12. The direction of air flow through heater 10 is depicted by arrows $F_a$. Finally, a control box 26 is located on one side of the heater.

Figure 2:
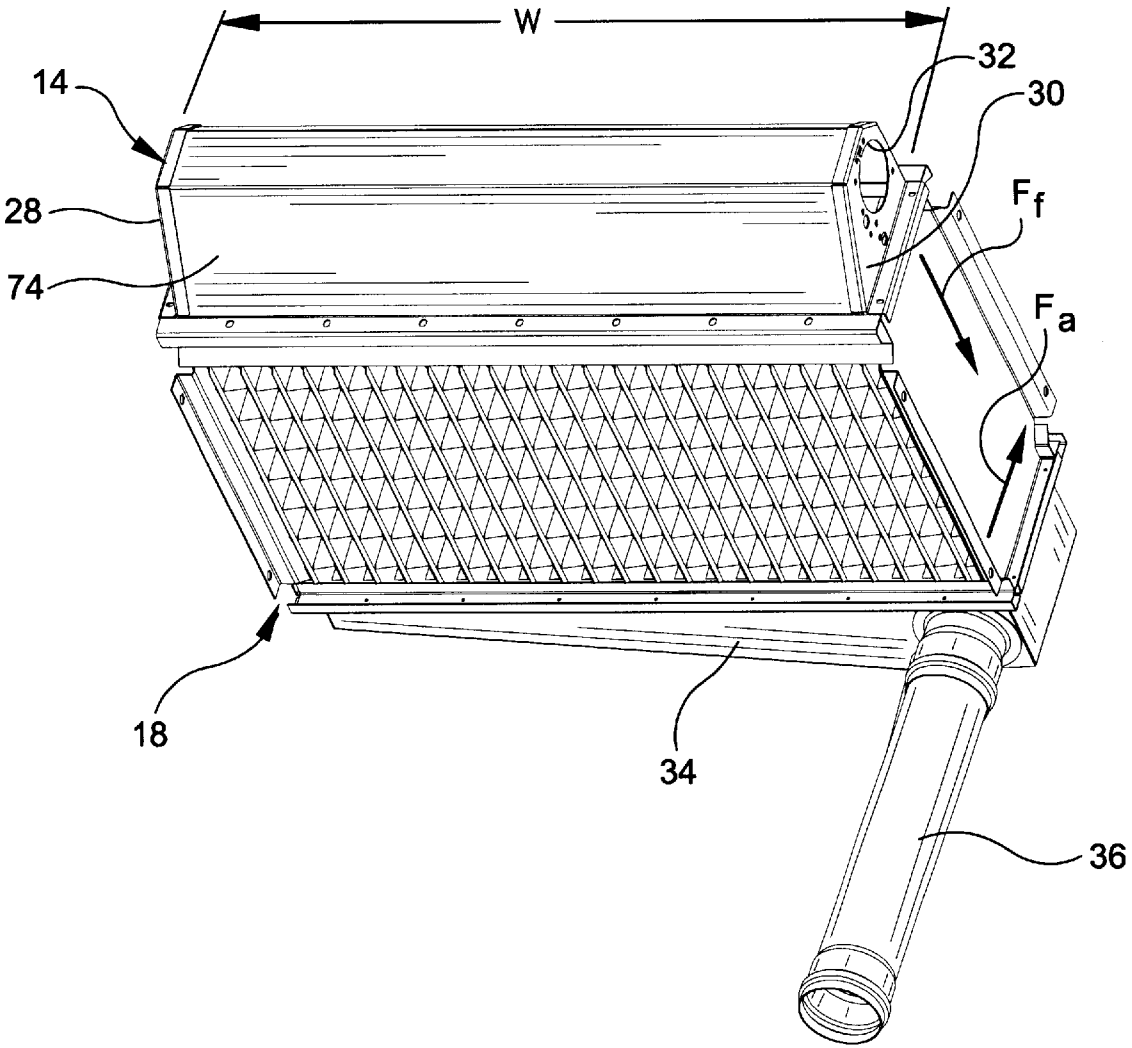
FIG. 2 is a perspective view of the combustion chamber/heat exchanger/collection box assembly.
Figure 3:
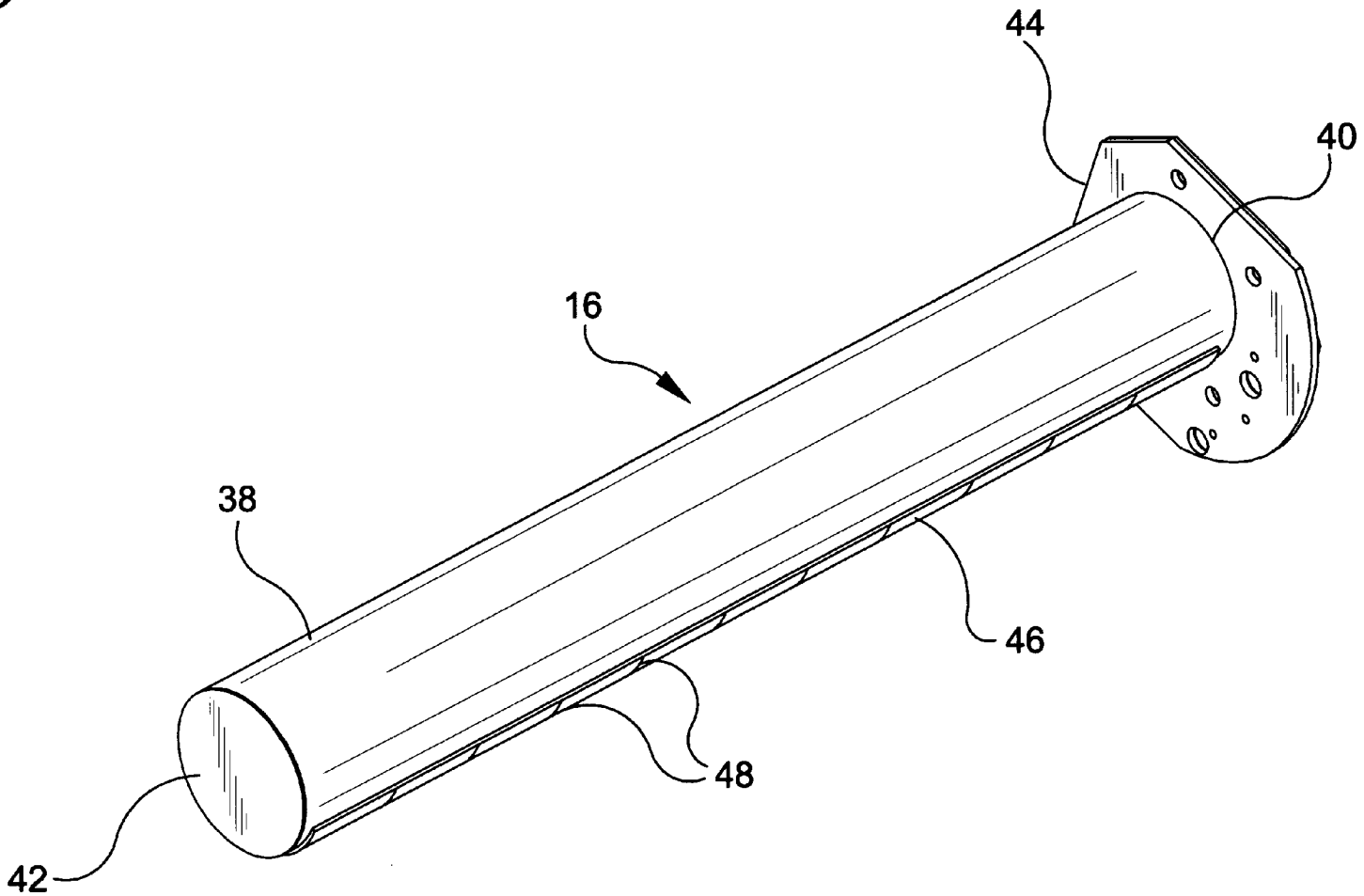
FIG. 3 is a detail of the burner.

As will be appreciated by those skilled in the art, a combustible fuel is burned within burner 16, thus providing hot combustion product gases (commonly referred to as hot flue gases) which travel through heat exchanger 18 in the direction of arrow $F_f$. Referring now to FIG. 2, combustion chamber 14 is preferably positioned vertically above heat exchanger 18, and preferably extends substantially across the width w of heat exchanger 18. Combustion chamber 14 includes a first side edge 28 and a second side edge 30. A burner installation aperture 32 is formed in edge 30 to allow burner 16 to be inserted therein.

A collection box 34 (best viewed in FIG. 2) is located vertically below heat exchanger 18 to collect the condensation which forms inside the heat exchanger (from cooling of the flue gases to a temperature below the dew point), and to allow such condensation to gravity drain out of the heat exchanger along with the waste flue gases. An outlet pipe 36 directs the waste flue gases and condensation out of the heater unit. The waste flue gases and condensation are thereafter exhausted in accordance with conventional practice. Thus, the location of the combustion chamber vertically above the heat exchanger (as shown in FIGS. 1A and 2) allows the condensation which forms within the heat exchanger to drain by gravity out of the heat exchanger. Although the use of a "gravity method" to remove condensation from inside the heat exchanger is desirable, it is contemplated herein that the location of the combustion chamber with respect to the heat exchanger can be varied and that other techniques of removing the condensation from the heat exchange could be utilized.

Referring now to FIGS. 3, 4, 5 and 5A, burner 16 includes a cylindrical chamber 38, which is open at end 40 but closed at end 42. Open end 40 is secured to a flange 44, which allows attachment of the burner to edge 30 of combustion chamber 14. A slot 46, preferably rectangular in shape and including a plurality of support ribs 48, is formed along the length of chamber 38. The slot is thereafter covered with a burner surface 50, e.g., a woven metallic fiber (See FIG. 5A).

Figure 4:
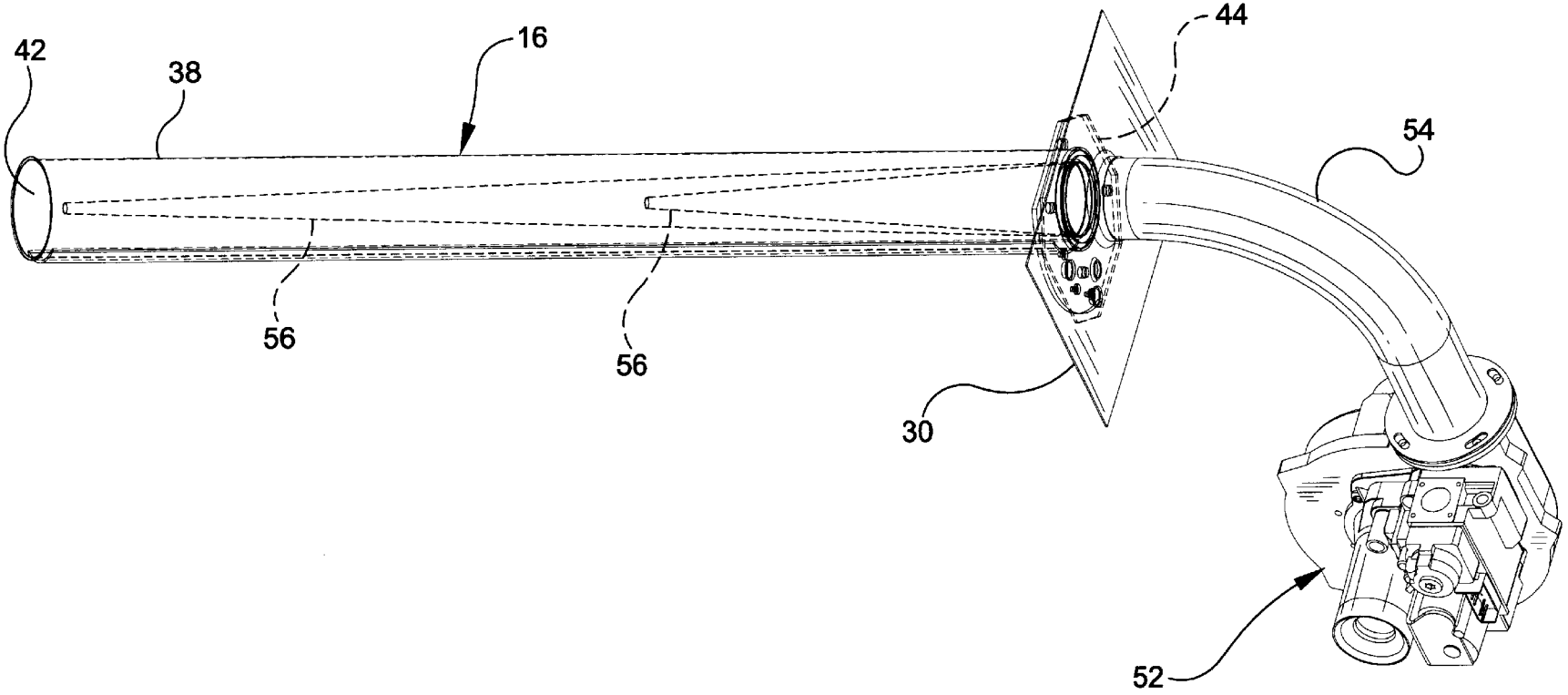
FIG. 4 is a detail of the burner and cooperating combustion fan.

As shown in FIG. 4, burner 16 is connected to a combustion fan 52 via a pipe 54. The combustion fan blows a combustible fuel (e.g., natural gas) into chamber 38 of burner 16. The flame from the ignited fuel propagates across burner surface 50. The hot flue gases leave the burner surface and travel through heat exchanger 18 in the direction of arrow $F_f$ due to the flow produced by combustion fan 52. Finally, a plurality of cone-shaped distribution inserts 56 are positioned within chamber 38 to help facilitate an equal distribution of fuel along the length of the slot.

Referring now to FIGS. 6–9, heat exchanger 18 is a cross-flow type heat exchanger constructed from a plurality of stacked corrugated plates 58*a*, 58*b*. Each of the plates includes opposing outer flanges about the periphery of the plates. Preselected flanges of the stacked plates are then brazed together to provide an assembly of plates having a plurality of flue gas passages extending in a first direction and a plurality of air passages extending crosswise through the heat exchanger in a second direction. The adjacent plates thereby define alternating flue gas passages and air passages. The brazed together assembly of plates are supported via a frame 60. It will be recognized that such a design is modular in concept, and that the size of the heat exchanger can be readily varied by changing the size of the plates and/or increasing or decreasing the number of adjacent plates. Thus, a heat exchanger having N flue gas passages includes N+1 air passages, and requires 2N+1 plates to construct. The design of burner 16 facilitates the modular concept of the heater in that a change in the size of the heat exchanger merely involves a change in the diameter and/or length of cylindrical chamber 38 of the burner.

Together, the assembly of plates defines a cool air inlet side 62, a heated air outlet side 64, a hot flue gas inlet side 66 and a cool flue gas outlet side 68. The corrugations are provided by forming a plurality of ribs 70 on the plates. In warm air heating applications, the mass flow of flue gas through the heat exchanger is significantly smaller than the mass flow of air through the heat exchanger. It is therefore desirable to design the air flow passages to provide less "resistance" to the air flowing therethrough than encountered by the flue gases flowing through the flue gas passages. This "unequal" resistance through the heat exchanger can be accomplished via the orientation of ribs 70 in the various passages. For example, on one plate (e.g., plate 58*a* shown in FIG. 8) the ribs are inclined at an angle of minus 30° (with respect to the horizontal), and on the adjacent plate (e.g., plate 58*b* shown in FIG. 9) the ribs are inclined at an angle of plus 30° (with respect to the horizontal). The more this angle is changed, the more "unequal" the restrictions through the two sets of passages. The angle of the inclination is preferably in the range of 15° to 35°.

Figure 6:
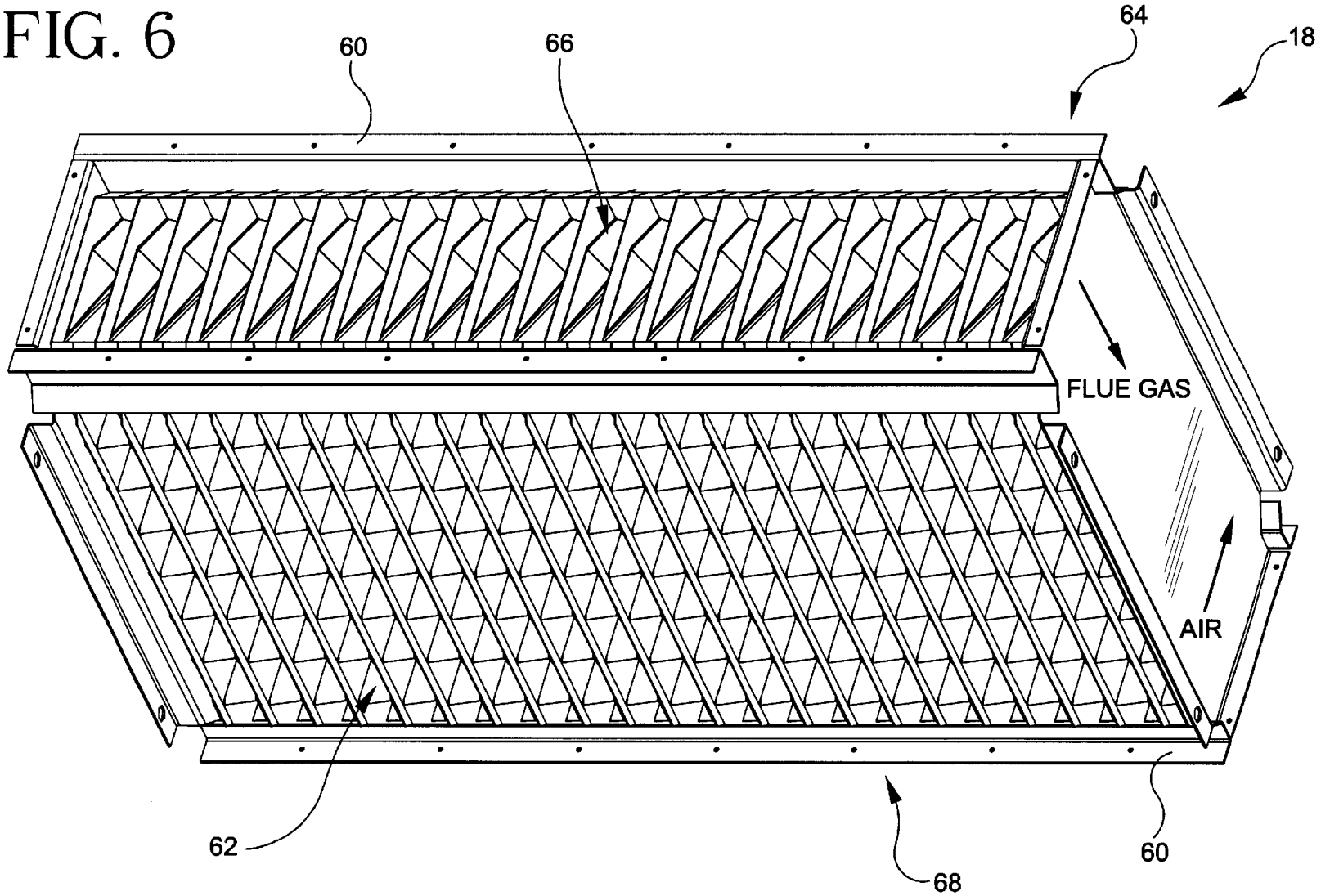
FIG. 6 is a perspective view of the heat exchanger.
Figure 7:
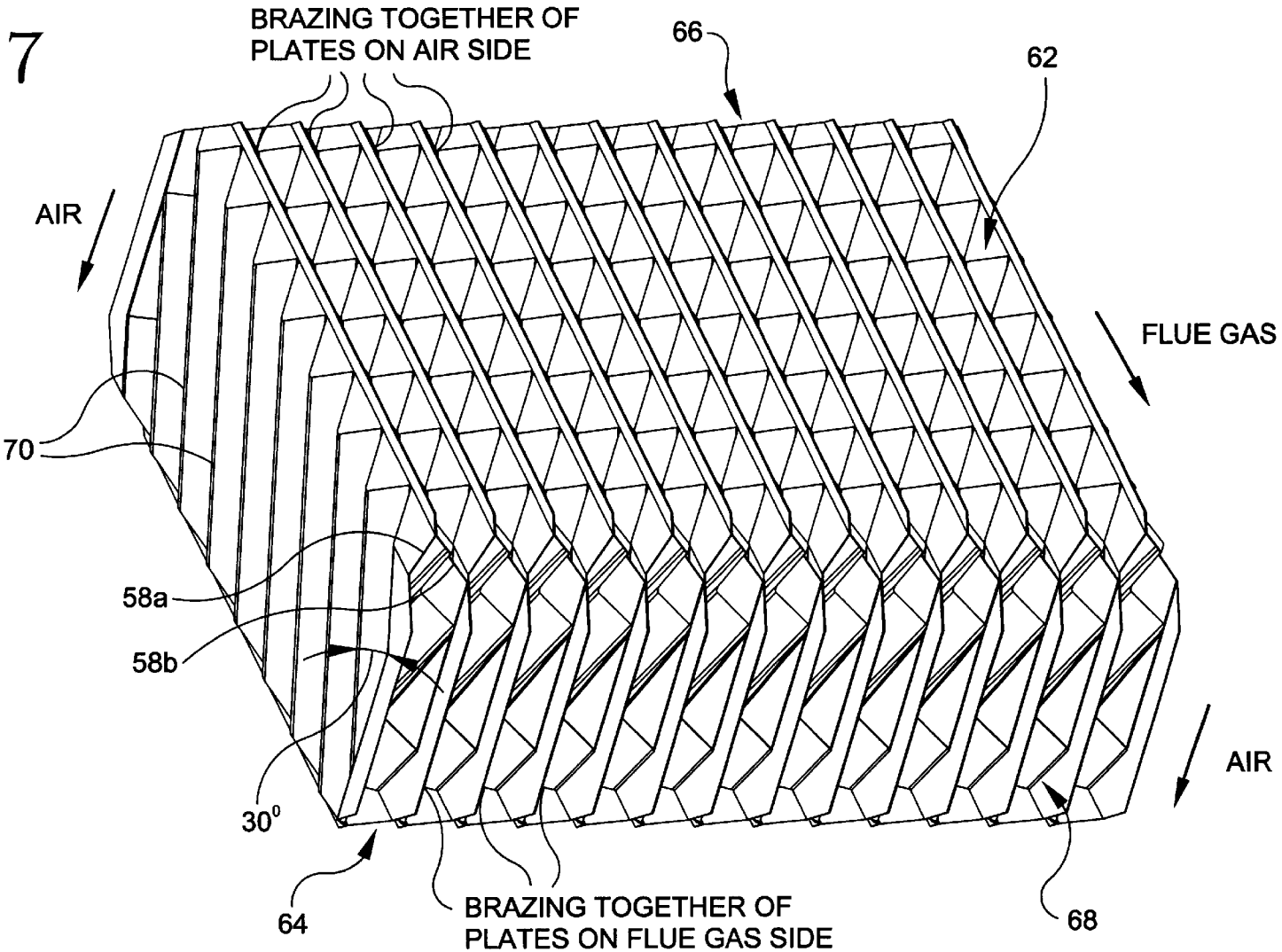
FIG. 7 is a perspective view of the heat exchanger of FIG. 6 with the frame removed.

As shown in FIGS. 6–7, ribs 70 are formed with a height such that the intersecting ribs of adjacent plates make contact with each other. This reinforces the construction of the heat exchanger in that each of these contact points is brazed together during assembly of the heat exchanger. The corrugation of the plates (i.e., the ribs formed on the plates) increases the turbulence of the flow through the heat exchanger, which improves the efficiency of the heat transfer process. Heat exchanger 18 thus provides a significantly more compact design than prior art heat exchangers, and at the same time provides a heat transfer efficiency of 90% plus even with only a single stage. Based on this compact heat exchanger, together with the reduction in size of the combustion chamber described hereinbelow, the overall size of the present heater has been reduced in volume by approximately 40–50% as compared to a conventional prior art heater having the same heat output capacity.

Referring back to FIGS. 1A and 2, heater 10 includes at least one air bypass channel 72, which directs a portion of the cool air drawn into heater 10 around exterior surface 74 and side edges 28, 30 of combustion chamber 14. Heater 10 may include a bypass control device 76 which regulates the amount of air which is bypassed around combustion chamber 14 and/or the direction of the bypass air. As the bypass air flows around combustion chamber 14, heat transfer occurs between the housing of the combustion chamber and the bypass air.

The bypass air channel described herein provides several significant advantages. First, it is easier (i.e., it takes less energy) to push the cool air through the bypass channel surrounding the combustion chamber than to push the cool air through the passages of the heat exchanger. As a result, because fan 12 is not required to push all of the cool air through heat exchanger 12 (which would take additional energy), a smaller sized fan than would otherwise be needed may be incorporated into the heater thus leading to a savings in energy costs.

Next, the bypass channel described herein facilitates the overall design of the heater and of the heater/heat exchanger subassembly. It will be recognized that the temperature of the combustion product gases produced by burner 16 typically range from 1000° C. to 1400° C. As a result, the housing of combustion chamber 14 is subjected to extremely high temperatures. Prior art heaters have addressed these temperature concerns through the use of more expensive housing materials, the use of insulating materials, and an overall increase in the size of the combustion chamber which increases the distance between the burner and the combustion chamber housing thus allowing the hot combustion product gases to cool before contacting the combustion chamber housing. This, however, increases the overall size of the heater, which is disadvantageous in terms of shipping/handling of the unit, installation space requirements, manufacturing/material costs, and overall aesthetics. The bypass air channel of the present invention removes heat from the surfaces of the combustion chamber thus reducing the overall temperature of the combustion chamber and eliminating the need for more expensive materials, insulation and/or increased size. This removal of heat by the bypass air is also important in that it lowers the temperature of the flue gases entering the heat exchanger.

Figure 5:
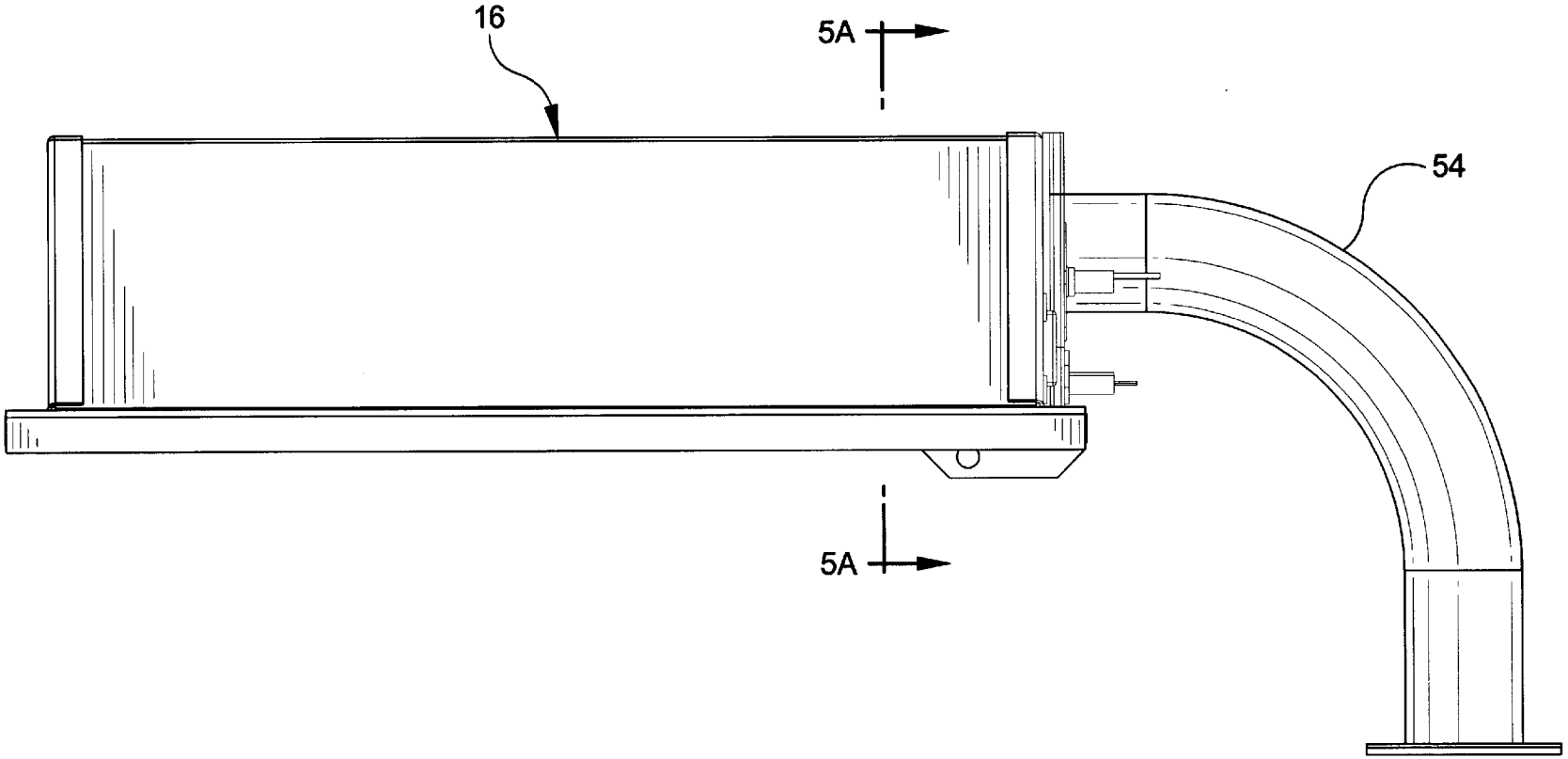
FIG. 5 is an elevational view of the combustion chamber.
Figure 5A:
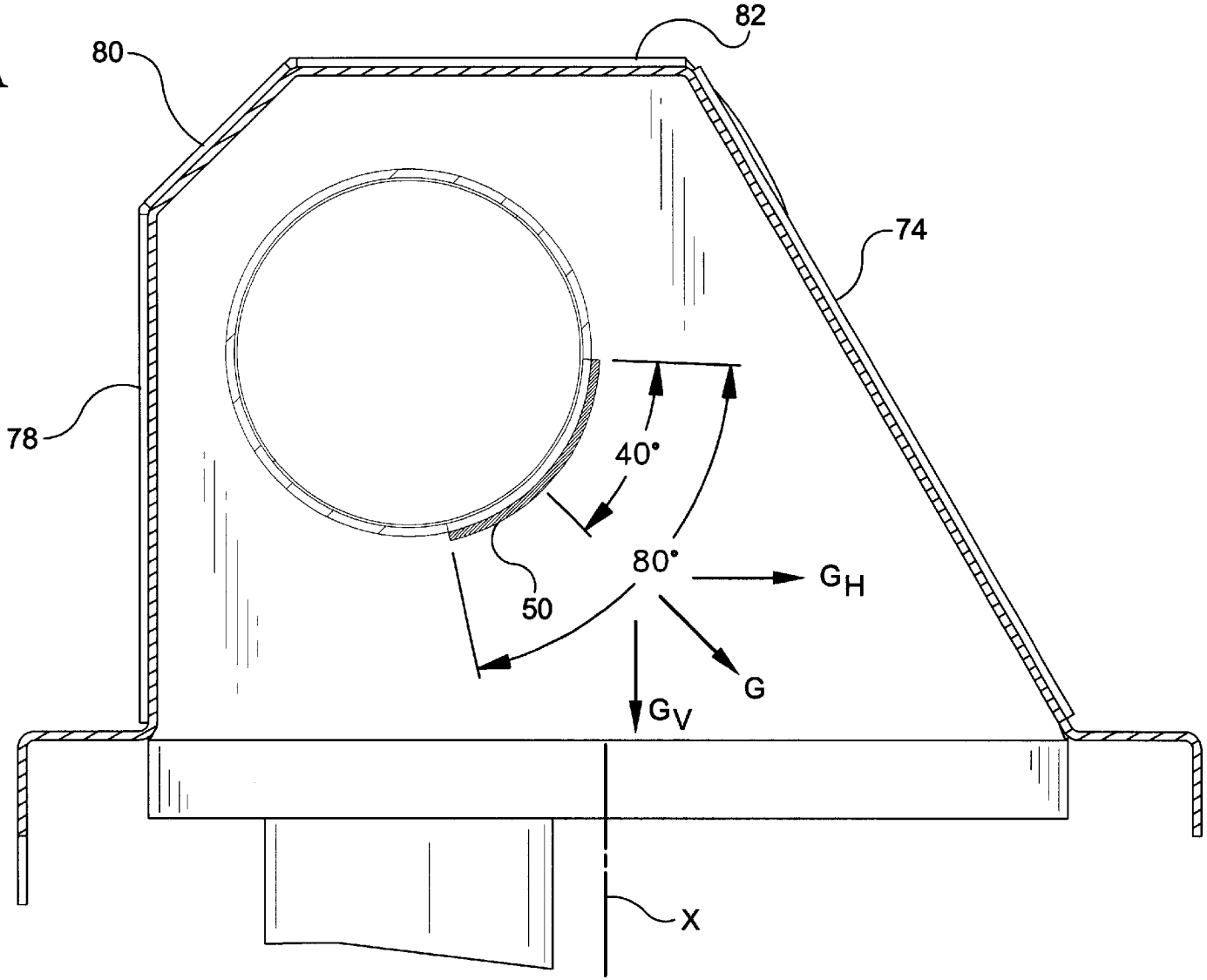
FIG. 5A is an enlarged sectional view taking along lines 5A—5A of FIG. 5.

Referring back to FIGS. 3, 4, 5 and 5A, the present invention provides a novel design for the combustion chamber/burner subassembly, which facilitates both the desired reduction in overall size of the combustion chamber and the heat transfer via the bypass air flow mentioned hereinabove. As discussed, burner 16 is provided with slot 46 that is covered by burner surface 50. It will be appreciated that the slot design of burner 16 allows the hot flue gases to be initially oriented in a predetermined direction. As shown in FIG. 5A, slot 46 extends through an arc of approximately 80°, and is preferably oriented so that the center of the slot is oriented at approximately 40° from the horizontal thus producing a flow of hot flue gases in the direction of arrow G. It can be seen that the orientation of burner 16 thus directs the flow of the flue gases towards the upper surface of the heat exchanger, and includes both a horizontal component $G_H$ and a vertical component $G_V$. The horizontal component $G_H$ thus heats surface 74 of combustion chamber 14 thereby facilitating the heat transfer process via the bypass air flow. It will be further appreciated that by directing the flue gases away from surfaces 78, 80 and 82 of the combustion chamber, the distance between these wall surfaces and the burner can be reduced thus allowing the size of the combustion chamber to be reduced. As a result, burner 16 is located off-center with respect to an axis X extending through the middle of heat exchanger 18. Accordingly, the slot design of burner 16 allows the size of the combustion chamber to be reduced, while still ensuring that the flue gases are distributed over the flue gas inlet surface of the heat exchanger, and while directing a portion of the flue gases towards surface 74 of the combustion chamber.

Figure 10B:
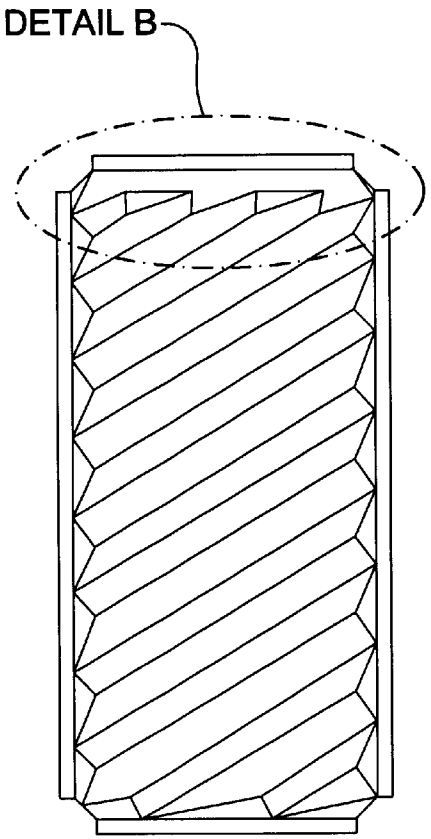
FIG. 10B is a detail of one of the plates used to construct the heat exchanger of FIG. 10A wherein the upper portion of the plate is non-corrugated.
Figure 10A:
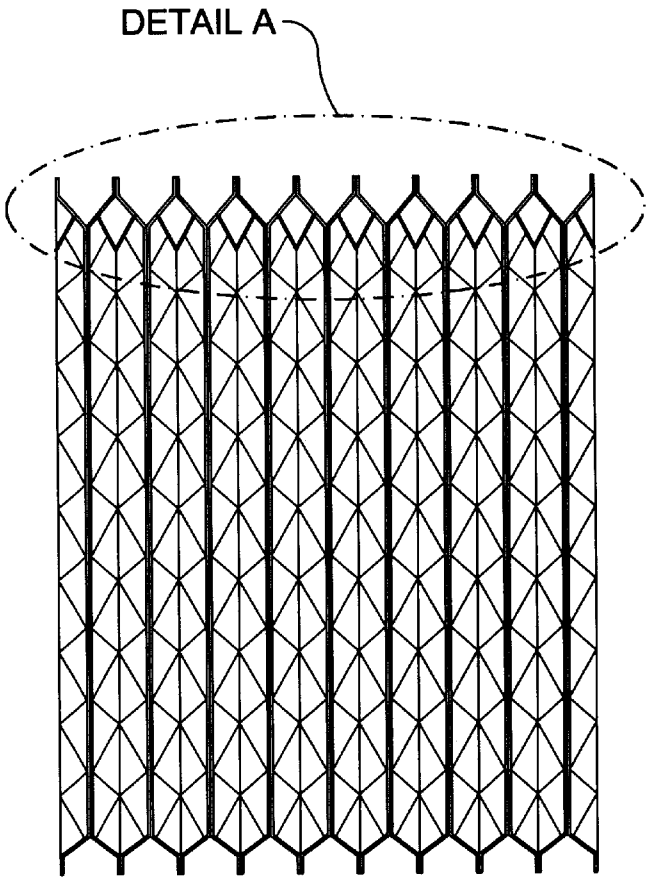
FIG. 10A is a front elevational view showing a portion of a heat exchanger wherein the upper portion includes modified air passages for increased air flow.

Although the inclusion of air bypass channel in accordance with the present invention result in cooling of the flue gasses while still in the combustion chamber, the flue gas inlet side 66 of the heat exchanger is nonetheless exposed to extremely high temperatures. It has been discovered herein that by modifying the air flow passages through the upper portion of the heater exchanger (See detail A of FIG. 10A), the exposure of the heat exchanger to high temperatures can be tolerated. More particularly, it has been discovered that by increasing the flow rate of the air through the channels in the upper portion of the heat exchanger, sufficient heat can be removed from this portion of the heat exchanger without necessitating the use of expensive high temperature materials. This increased air flow may be accomplished by removing the corrugations from the plates in the upper portion of the heat exchanger (see detail B of FIG. 10B). This higher air flow through the upper portion of the heat exchanger also results in a decrease in the temperature gradient exhibited at the air outlet side of the heat exchanger.

Figure 9:
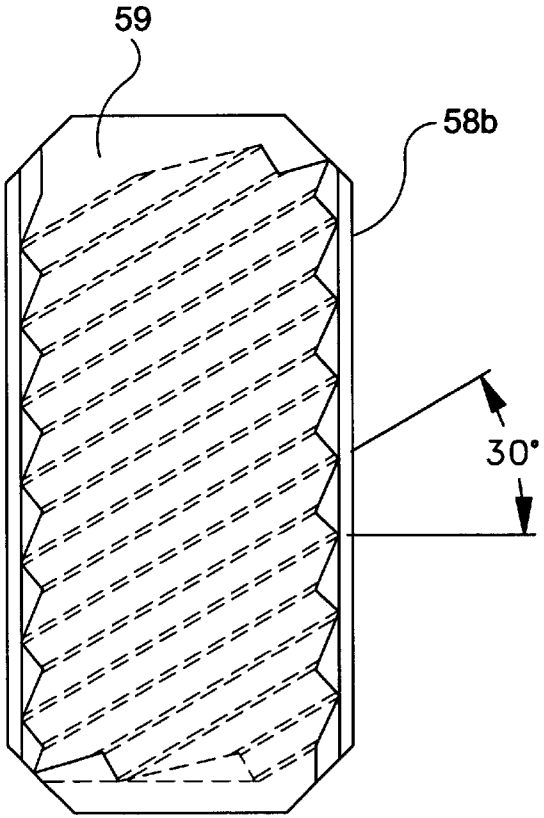
FIG. 9 is an elevational view of a second corrugated plate used to construct the present heat exchanger.
Figure 8:
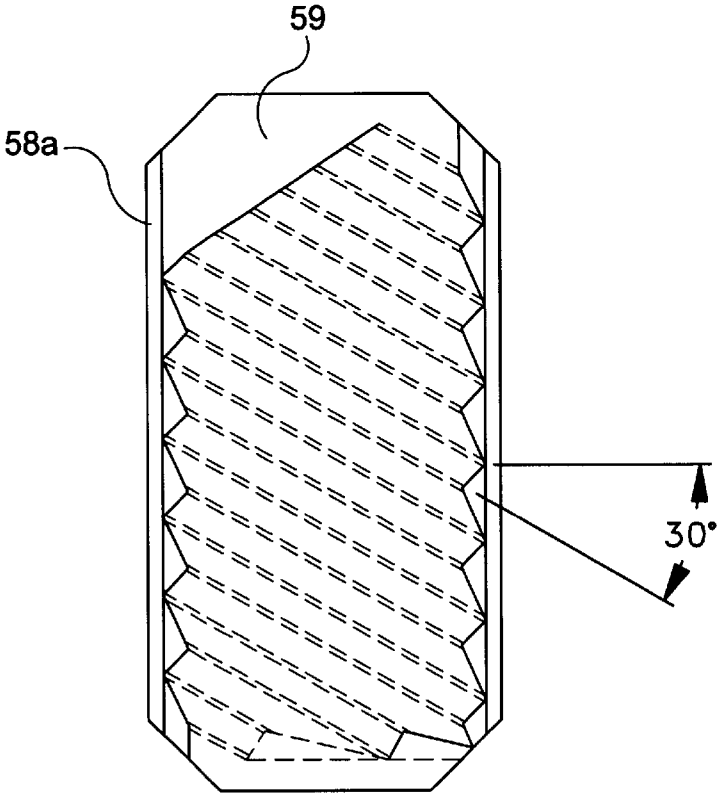
FIG. 8 is an elevational view of a first corrugated plate used to construct the present heat exchanger.

In one preferred embodiment, the upper portion of the heat exchanger is designed such that the upper left hand portion of the plates 58*a*, 58*b* (as viewed in FIGS. 8 and 9) includes a non-corrugated region 59 which is shaped as to provide a funnel for the incoming air flow (from left to right in FIGS. 8 and 9). This funnel-shaped entrance facilitates the capture of the incoming air flow and the direction of this incoming air flow along the upper interior surface of the heat exchanger.

Figure 11:
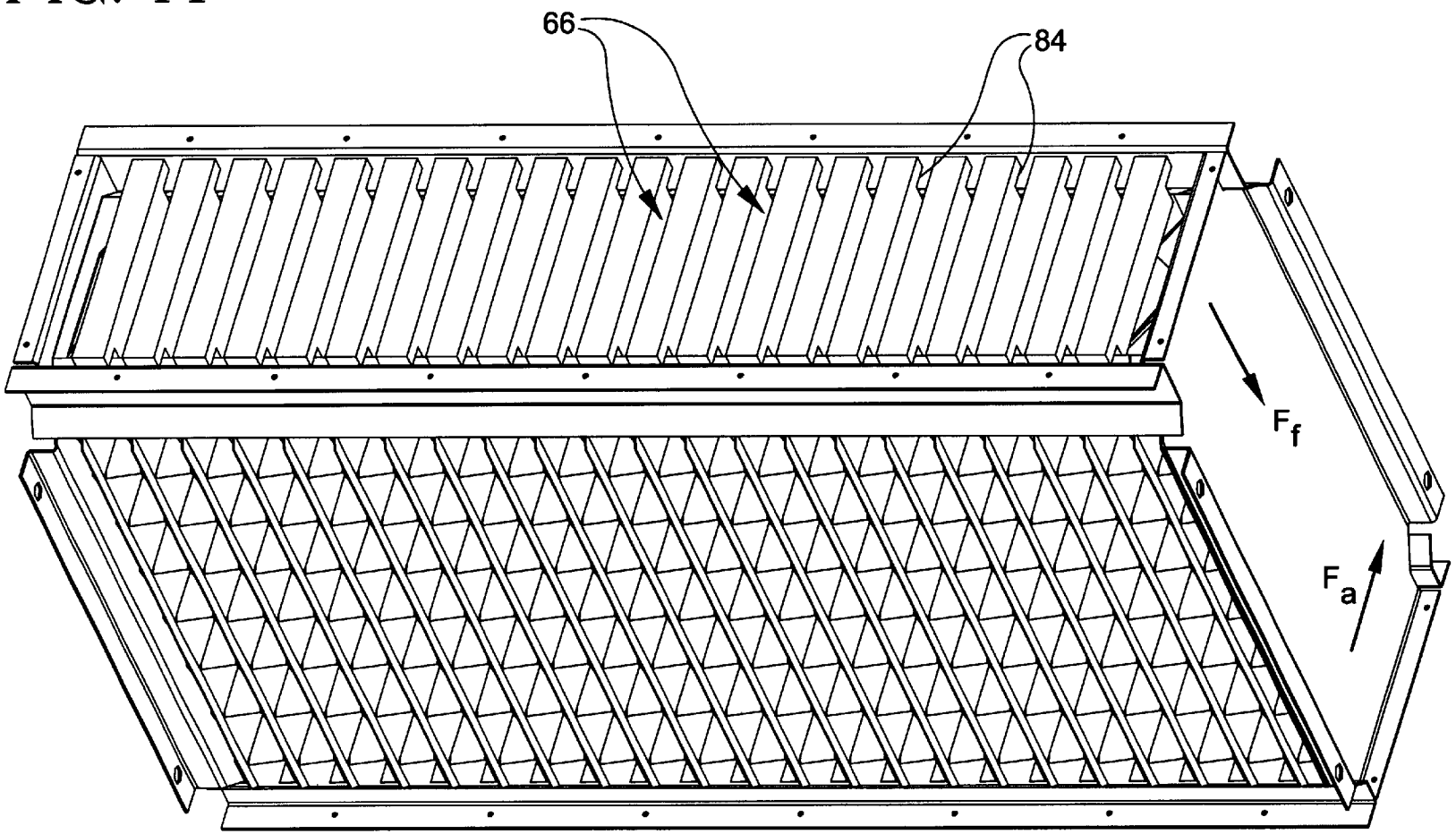
FIG. 11 is a perspective view of the heat exchanger wherein a plurality of heat shields have been installed along the flue gas inlet side.
Figure 12B:
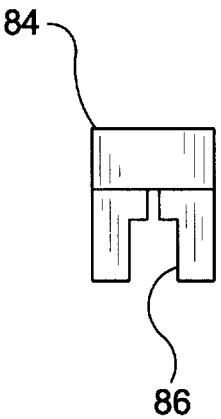
FIG. 12B is a side elevational view of the heat shield of FIG. 12A.
Figure 12A:
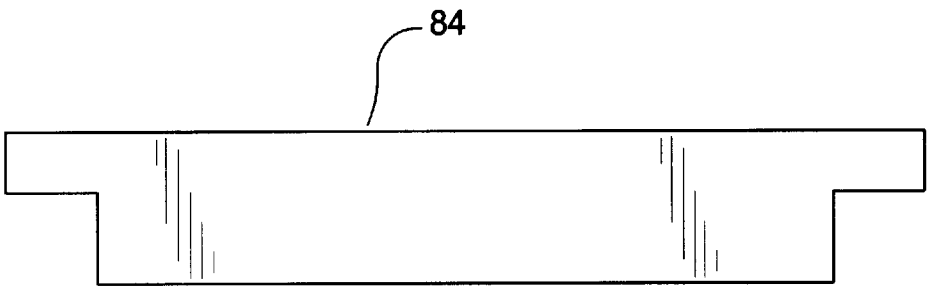
FIG. 12A is a detail of the heat shield shown in FIG. 11.

Referring now to FIGS. 11, 12A and 12B, a plurality of heat shields 84 formed from an insulating ceramic fiber are preferably located along the flue gas inlet side 66 of the heat exchanger. These heat shields are spaced apart from one another to allow the hot flue gases to flow into the flue gas passages of the heat exchanger. A pair of bracket members (not shown) may be installed along the width of the heat exchanger to secure the heat shields to the heat exchanger. Each of heat shields 84 includes an interior protective zone 86 sized to surround the brazed flanges located along the flue gas inlet side 54 of the heat exchanger. Heat shields 84 thus insulate the brazed flanges (which are not directly cooled by the air flow through the heat exchanger) from direct exposure to the hot flue gases. The heat shields are also modular in concept in that the heat exchanger requires one heat shield between each flue gas passage. It is contemplated herein that the flange portions of the brazed plates along the flue gas inlet side can also be protected from the heat of the flue gases through various coatings (e.g., ceramics), and also that the shape of heat shield 84 can be modified and/or go streamlined to facilitate the flow of the flue gases thereby.

The tendency of warm air to rise within a room creates a condition known as "stratification", wherein the temperature near the ceiling of a room is greater than the temperature near the floor of the room. This condition of stratification can cause discomfort to persons working within the environment. Heaters, such as heater 10 described herein, are often installed at an elevated location in the room, e.g., the heater may be suspended from the ceiling. This installation of the heater at a higher elevation than the persons working in the room makes it more difficult to ensure that an adequate supply of warm air is being provided to the lower regions of the room.

However, it has been recognized herein that certain features can reduce this undesirable "stratification". For example, the temperature gradient exhibited along the air outlet surface of heat exchanger 18 (wherein the surface is significantly hotter in the region near the combustion chamber) can increase the likelihood of stratification, and lead to discomfort problems within the working environment. Although the bypass air exiting the heater (arrow F1 of FIG. 1) has been heated through heat transfer from the combustion chamber housing, the temperature of this exiting bypass air is less than the temperature of air exiting from the upper portion of the heat exchanger (i.e., arrow F2 of FIG. 1). The mixture of flow F1 and F2 reduces the overall temperature of the flow exiting from the upper region of the heat exchanger, thus tending to reduce the temperature gradient over the exit surface of the heat exchanger and at air exit 24 of heater 10. Moreover, as shown in FIG. 1, housing 20 preferably includes a plurality of louvers 88 along air exit 24, which are designed to mix the heated air exiting the heat exchanger and to direct the heated air exiting the heater in a desired direction, e.g., downward into the room.

Figure 13:
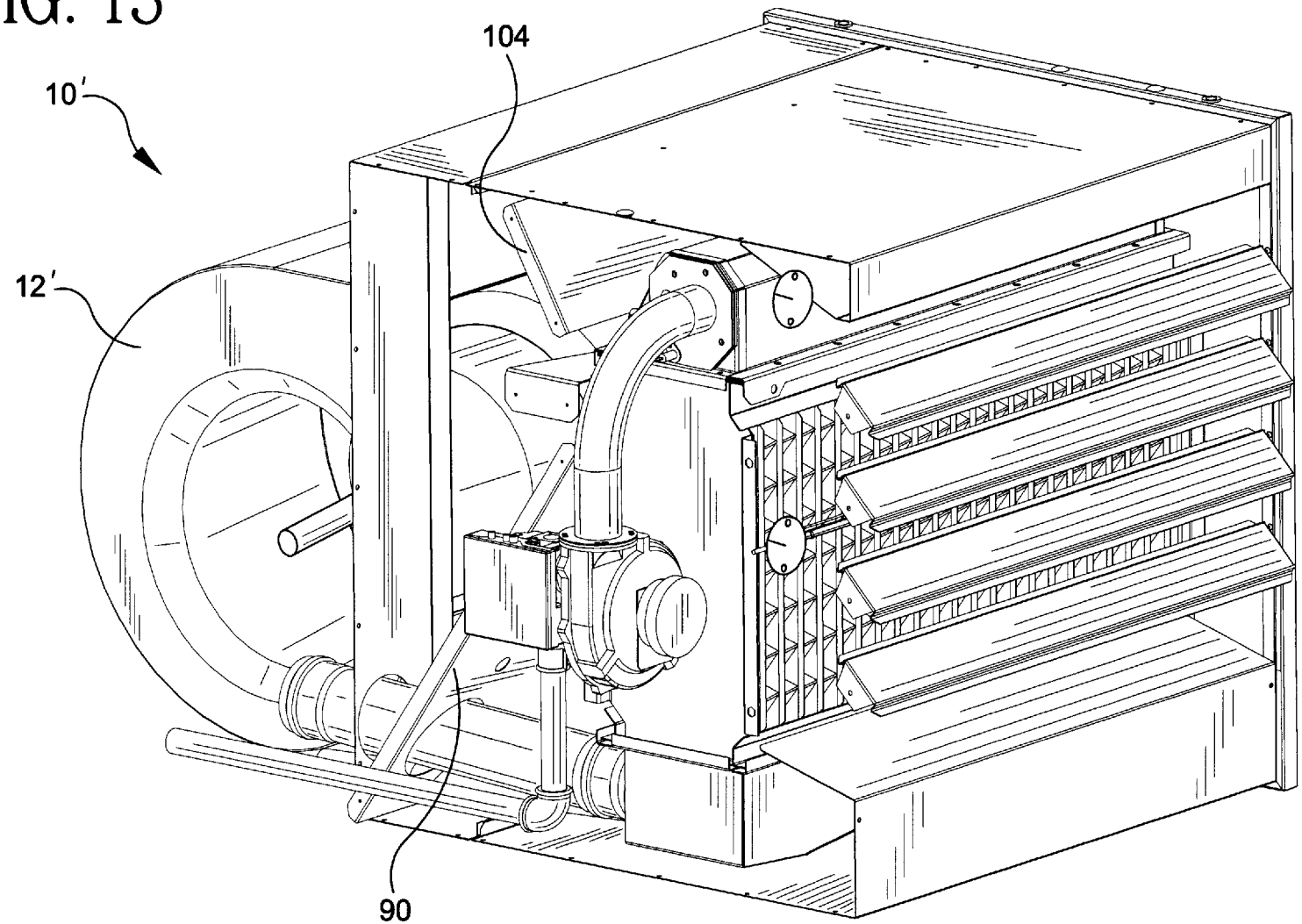
FIG. 13 is a perspective view of an alternative heater in accordance with the present invention.
Figure 14:
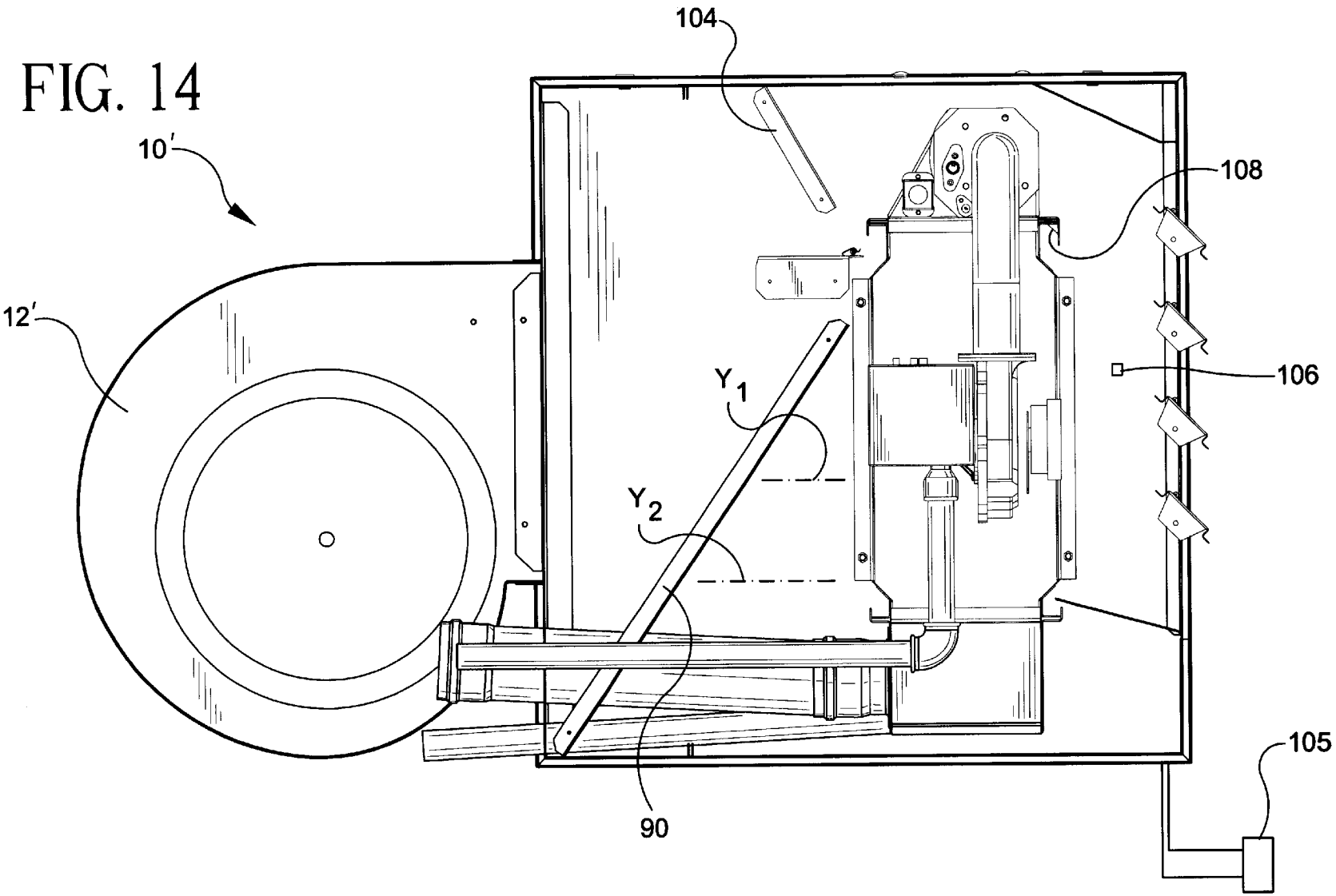
FIG. 14 is a side elevational view of the heater of FIG. 13.
Figure 15:
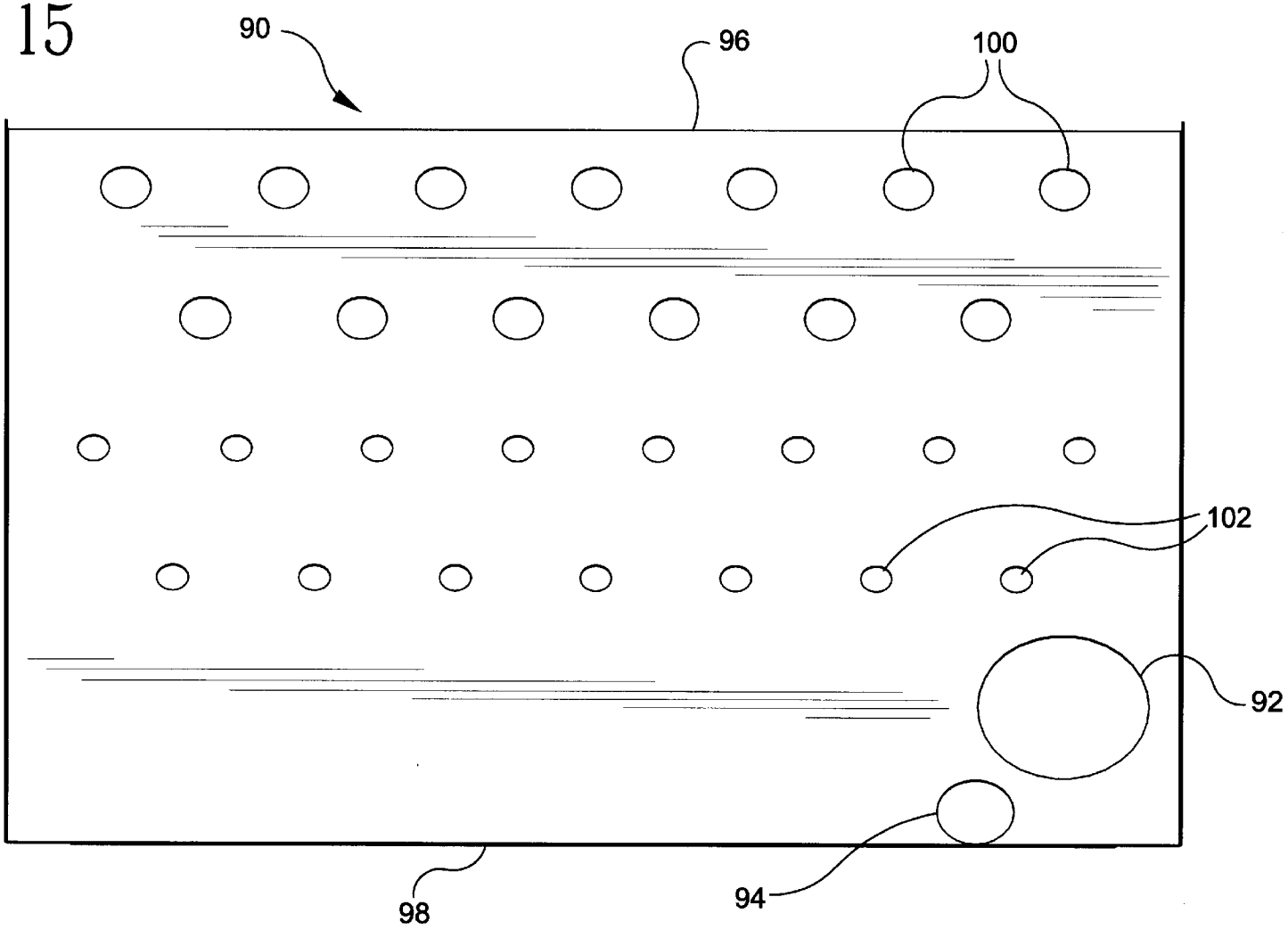
FIG. 15 is a detail of an air distribution plate incorporated into the heater of FIG. 13.

An alternative heater, e.g., heater 10', is shown in FIGS. 13–14. As shown, heater 10' utilizes an external fan 12', rather than the internal fan of heater 10. An air distribution plate 90 is preferably positioned within heater 10' on the air inlet side of the heat exchanger. Preferably, the plate does not restrict the air flow through the upper funnel-shaped region of the plates. As best shown in FIG. 15, plate 90 includes a plurality of air flow apertures of varying sizes, an outlet pipe aperture 92 and a second pipe aperture 94. The apertures decrease in size in a direction from edge 96 to edge 98, thus restricting the amount of air flow through the heat exchanger in this direction. Of course, the size and/or configuration of the apertures in distribution plate 90 can be varied.

It will be appreciated that plate 90 facilitates the distribution of air over air inlet side 62 in a manner which reduces the temperature gradient exhibited on the air outlet side of the heat exchanger. As mentioned, the flue gases decrease in temperature as they travel through heat exchanger 18. The flue gases are therefore at a higher temperature at an elevation $Y_1$ (see FIG. 14) corresponding to the location of apertures 100 than at an elevation $Y_2$ corresponding to the location of apertures 102. Assuming equal flows of air through the heat exchanger at these two different elevations, the air flow at the higher elevation will have a higher temperature at the air outlet surface of the heat exchanger than the air flow at the lower elevation. By reducing the air flow at the lower elevation, the air which does pass through the heat exchanger at this lower elevation is heated to a higher temperature than would otherwise be accomplished without the distribution plate. The incorporation of a distribution plate can thus significantly reduce the temperature gradient exhibited at the air outlet side of a cross-flow heat exchanger. Finally, heater 10' includes a diverter plate 104 positioned to facilitate the balancing of the air flow between the bypass channels and the heat exchanger.

The heat exchanger of the present invention is preferably provided with a comfort regulation control mechanism which controls both the caloric input and the air volume of the heater. The purpose of the comfort regulation control mechanism is to optimize the operation of the heater and to address stratification in the room. The regulation of the heat output is accomplished by regulating the caloric input of the burner, while the regulation of the air flow is accomplished by changing the set point of the blower between a high air flow setting and a low air flow setting.

Figure 16:
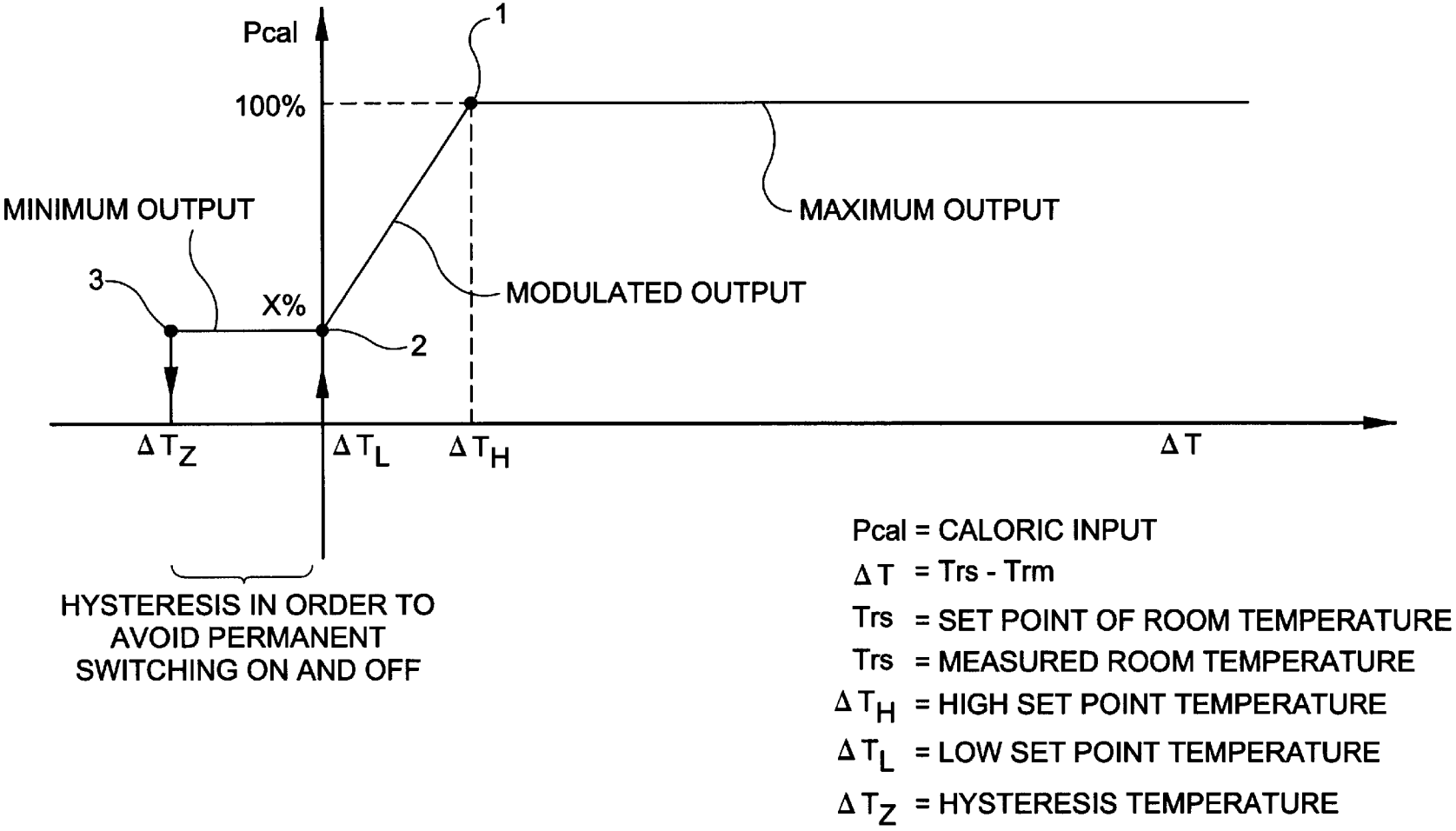
FIG. 16 is a graphical depiction of the burner output vs temperature difference.

Referring to FIG. 16, the heat output of the burner is regulated between a preset maximum and a preset minimum (which ensures proper operation of the burner). When $\Delta_T$ is equal to or greater than $\Delta T_H$, the burner is operated at its preset maximum full heat output. As $\Delta T$ falls below $\Delta T_H$, the control system of the heater begins to modulate (i.e., decrease) the heat output of the burner (this modulation occurs between points 1 and 2 of FIG. 16). Once $\Delta T$ falls below $\Delta T_L$, the burner is operated at its preset minimum heat output (from point 2 to point 3 of FIG. 16). At point 3, $\Delta T$ equals $\Delta T_Z$, and the burner is then switched off. As $\Delta T$ increases, the burner is not switched on until $\Delta T$ equals $\Delta T_L$, thus preventing constant on/off cycling of the heater. As a result, a fast heat-up time (without an overshoot effect) is accomplished.

The regulation of the air flow of the unit is normally a function of the temperature difference between the outlet temperature of the heater and the room temperature, except in two conditions. First, for a fixed time after startup, the blower remains off, thus allowing the heater to quickly warm up, and not distribute cold air into the room. Second, as a safety measure, the heater will automatically turn off if a certain predetermined temperature is exceeded. The system therefore requires three temperature sensors (see FIG. 14): a first sensor 105 to measure the room temperature (typically at an elevation near the persons working in the room, a second sensor 106 to measure the outlet temperature of the unit, and a third sensor 108 to measure the temperature of the heat exchanger (for the safety shut-off only).

Figure 17:
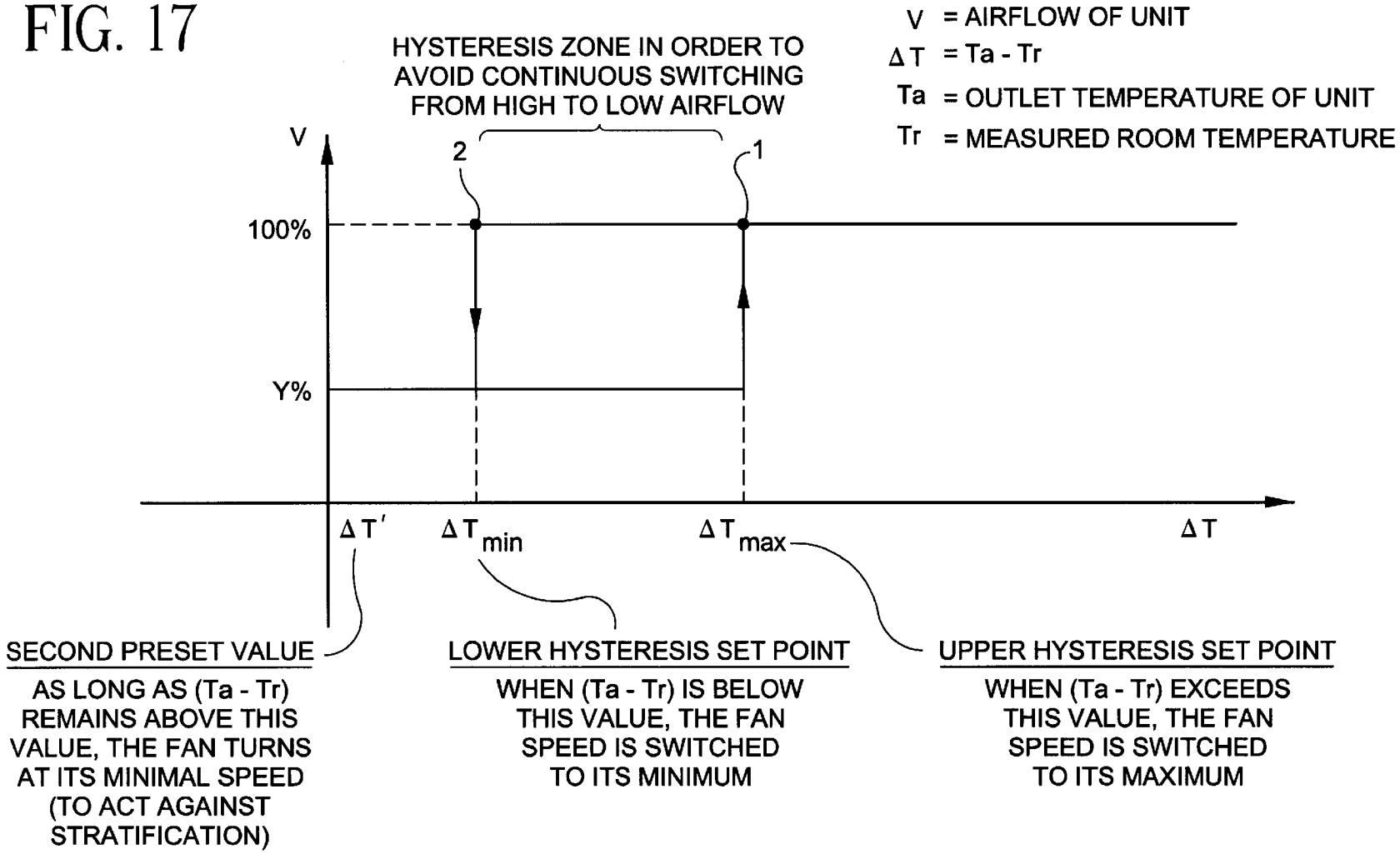
FIG. 17 is a graphical depiction of the air flow vs temperature difference.

When the temperature difference between the outlet temperature of the unit and the room temperature exceeds a preset value, the blower is switched to its maximum air flow (see FIG. 17). This avoids stratification in two ways: the high air flow reduces the outlet temperature of the air, and the circulation of the air in the room increases, resulting in an improved mixture of warm air with cold air.

When this mentioned temperature difference falls below this preset value, the blower is switched back to the low speed setting. The system includes a hysteresis control to avoid continuous high/low switching of the blower. Thus as $\Delta T$ decreases from point 1 to point 2, the blower remains at the high speed setting. Once $\Delta T$ min is reached, the blower is switched to the low speed setting. The blower will not reswitch to the high speed setting until $\Delta T$ equals $\Delta T$ max. It will be appreciated that the difference between the outlet temperature and the room temperature includes both the temperature rise due to the heat exchanger and the vertical temperature difference in the room (stratification effect).

To further improve the comfort regulation, there is also a control loop which operates when the burner is off (no heat output). This loop is operated based on the difference between the outlet temperature of the unit and the room temperature. As long as the measured temperature difference between the outlet of the unit and the room temperature is above a second preset value, the blower is switched to its low speed setting. When the measured temperature difference falls below this second preset value, the blower is switched off. Again, a hysteresis control is integrated into this control loop to prevent constant on/off switching of the blower. It will be appreciated that this second preset value is smaller than the first preset value (which controls the on/off switching of the burner) because this second loop merely monitors the vertical temperature difference in the room, and is not responsible for adding heat to the room.

The comfort control system of the present heater thus integrates the heating of a room by a suspended air heater with an anti-stratification control system. This integrated comfort control system thus reduces uncomfortable temperature swings in the room thereby increasing the overall comfort level to the persons working in the room. The comfort control system also reduces energy cost through improved regulation and control of the heater.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendment and/or deviations be included within the scope of the following claims.

What is claimed is:

1. An air heater, comprising:

a burner for burning a combustible fuel to provide flue gases;

a combustion chamber surrounding said burner;

a heat exchanger defining a plurality of flue gas passages and air passages and further defining an air inlet side, an air outlet side, a flue gas inlet side and a flue gas outlet side, and wherein said combustion chamber communicates with said flue gas inlet side of said heat exchanger to direct said flue gases through said flue passages;

at least one bypass channel which directs air flow across at least one surface of said combustion chamber to remove heat from said surface; and a bypass control device for regulating at least one of the amount of air flow through said bypass channel and the direction of air flow through said bypass channel.

2. The air heater according to claim 1, wherein said burner includes a cylindrical chamber having a slot formed along its length; and further comprising a combustion fan communicating with said cylindrical chamber for directing said combustible fuel into said cylindrical chamber and out of said slot, and a burner surface located over said slot to facilitate burning of said fuel; and wherein said slot is oriented at a predetermined angle with respect to said flue gas inlet side.

3. The air heater according to claim 2, wherein said slot is oriented to provide said flue gases with an initial direction G having both a horizontal component $G_H$ and a vertical component $G_V$; and wherein said horizontal component $G_H$ directs said flue gases against said surface of said combustion chamber.

4. The air heater according to claim 3, wherein said slot extends through an arc of approximately 80°, and wherein said slot is oriented at an angle of approximately 40° with respect to a horizontal axis.

5. The air heater according to claim 4, wherein said slot is rectangular; and further comprising a plurality of cone-shaped distribution inserts configured to facilitate distribution of said combustible fuel along said slot.

6. The air heater according to claim 1, further comprising an air distribution plate located along said air inlet side of said heat exchanger, and wherein said air distribution plate includes a plurality of apertures decreasing in size in a direction extending from said flue gas inlet side to said flue gas outlet side whereby the mass flow of air through said heat exchanger is decreased in the direction extending from said flue gas inlet side to said flue gas outlet side thereby reducing the temperature gradient exhibited along the air outlet side of said heat exchanger.

7. The air heater according to claim 6, further comprising a diverter plate located within said housing to balance the flow of air between said bypass channel and said heat exchanger.

8. The air heater according to claim 1, further comprising a plurality of heat shields; and wherein said heat exchanger includes an assembly of stacked corrugated plates, each of said plates includes opposing outer flanges about the periphery thereof; and wherein preselected flanges of said stacked corrugated plates are brazed together to define said alternating flue gas and air passage; and wherein said heat shields include an interior protective zone for surrounding said brazed flanges of said heat exchanger along said flue gas inlet side of said heat exchanger.

9. The air heater according to claim 1, further comprising a comfort regulation control system having a first temperature sensor for monitoring room temperature at a working elevation and a second temperature sensor for monitoring room temperature at a second elevated elevation, said comfort regulation control system including a first control loop for switching said burner between an on condition and an off condition and for regulating the output of said burner between a preset minimum output and a preset maximum output;

a second control loop for switching said fan between an on condition and an off condition and for regulating said fan between a low setting and a high setting; and a third anti-stratification control loop for switching said fan between said off condition and said low setting when said burner is in said off condition.

10. The air heater according to claim 9, wherein each of said control loops includes a hysteresis region to limit continuous cycling of said burner and said fan.

11. The heater according to claim 1, wherein said combustion chamber is positioned vertically above said heat exchanger whereby condensation formed in said heat exchanger is removed by gravity draining.

12. The heater according to claim 11, further comprising a collection box located at said flue gas outlet side of said heat exchanger to collect said flue gases and said condensation and direct said flue gases and said condensation to a waste outlet.

13. The heater according to claim 1, further comprising a housing for surrounding and supporting said heat exchanger and having an air inlet and an air outlet.

14. The heater accordingly to claim 1, further comprising a blower for moving air through said housing and through said air passages of said heat exchanger.

15. An air heater, comprising:

a burner for burning a combustible fuel to provide flue gases, said burner including a cylindrical chamber having a slot formed along its length;

a combustion chamber surrounding said burner;

a heat exchanger defining a plurality of flue gas passages and air passages and further defining an air inlet side, an air outlet side, a flue gas inlet side and a flue gas outlet side;

wherein said slot is oriented in a pre-determined angle with respect to said flue gas inlet side; and wherein said slot is oriented to provide said flue gases with an initial direction G having both a horizontal component $G_H$ and a vertical component $G_V$; and wherein said horizontal component $G_H$ directs said flue gases against said surface of said combustion chamber.

16. The air heater according to claim 15, further comprising a combustion fan communicating with said cylindrical chamber for directing said combustible fuel into said cylindrical chamber and out of said slot, and a burner surface located over said slot to facilitate burning of said fuel.

17. The air heater according to claim 15, wherein said slot extends through an arc of approximately 80°, and wherein said slot is oriented at an angle of approximately 40° with respect to a horizontal axis.

18. The air heater according to claim 17, wherein said slot is rectangular; and further comprising a plurality of cone-shaped distribution inserts configured to facilitate distribution of said combustible fuel along said slot.

19. The air heater according to claim 15, further comprising an air distribution plate located along said air inlet side of said heat exchanger, and wherein said air distribution plate includes a plurality of apertures decreasing in size in a direction extending from said flue gas inlet side to said flue gas outlet side whereby the mass flow of air through said heat exchanger is decreased in the direction extending from said flue gas inlet side to said flue gas outlet side thereby reducing the temperature gradient exhibited along the air outlet side of said heat exchanger.

20. The air heater according to claim 15, further comprising a plurality of heat shields; and wherein said heat exchanger includes an assembly of stacked corrugated plates, each of said plates includes opposing outer flanges about the periphery thereof; and wherein preselected flanges of said stacked corrugated plates are brazed together to define said alternating flue gas and air passage; and wherein said heat shields include an interior protective zone for surrounding said brazed flanges of said heat exchanger along said flue gas inlet side of said heat exchanger.

21. The air heater according to claim 15, further comprising a comfort regulation control system having a first temperature sensor for monitoring room temperature at a working elevation and a second temperature sensor for monitoring room temperature at a second elevated elevation, said comfort regulation control system including a first control loop for switching said burner between an on condition and an off condition and for regulating the output of said burner between a preset minimum output and a preset maximum output;

a second control loop for switching said fan between an on condition and an off condition and for regulating said fan between a low setting and a high setting; and a third anti-stratification control loop for switching said fan between said off condition and said low setting when said burner is in said off condition.

22. The air heater according to claim 21, wherein each of said control loops includes a hysteresis region to limit continuous cycling of said burner and said fan.

23. The heater according to claim 15, wherein said combustion chamber is positioned vertically above said heat exchanger whereby condensation formed in said heat exchanger is removed by gravity draining.

24. The heater according to claim 23, further comprising a collection box located at said flue gas outlet side of said heat exchanger to collect said flue gases and said condensation and direct said flue gases and said condensation to a waste outlet.

25. The air heater according to claim 15, further comprising a housing for surrounding and supporting said heat exchanger and having an air inlet and an air outlet.

26. The air heater according to claim 15, further comprising a blower for moving air through said housing and through said air passages of said heat exchanger.

27. An air heater, comprising:

a burner for burning a combustible fuel to provide flue gases;

a combustion chamber surrounding said burner;

a heat exchanger defining a plurality of flue gas passages and air passages and further defining an air inlet side, an air outlet side, a flue gas inlet side and a flue gas outlet side, wherein said combustion chamber communicates with such flue gas inlet side of said heat exchanger to direct said flue gases through said flue passages; and an air distribution plate located along said air inlet side of said heat exchanger, and wherein said air distribution plate includes a plurality of apertures decreasing in size in a direction extending from said flue gas inlet side to said flue gas outlet side whereby the mass flow of air through said heat exchanger is decreased in the direction extending from said flue gas inlet side to said flue gas outlet side thereby reducing the temperature gradient exhibited along the air outlet side of said heat exchanger.

28. The air heater according to claim 27, further comprising a plurality of heat shields; and wherein said heat exchanger includes an assembly of stacked corrugated plates, each of said plates includes opposing outer flanges about the periphery thereof, and wherein said preselected flanges of said stacked corrugated plates are brazed together to define said alternating flue gas and air passage; and wherein said heat shields include an interior protective zone for surrounding said brazed flanges of said heat exchanger along said flue gas inlet side of said heat exchanger.

29. The air heater according to claim 27, further comprising a comfort regulation control system having a first temperature sensor for monitoring room temperature at a working elevation and a second temperature sensor for monitoring room temperature at a second elevated elevation, said comfort regulation control system including a first control loop for switching said burner between an on condition and an off condition and for regulating the output of said burner between a preset minimum output and a preset maximum output;

a second control loop for switching said fan between an on condition and an off condition and for regulating said fan between a low setting and a high setting; and a third anti-stratification control loop for switching said fan between said off condition and said low setting when said burner is in said off condition.

30. The air heater according to claim 29, wherein each of said control loops includes a hysteresis region to limit continuous cycling of said burner and said fan.

31. The heater according to claim 27, wherein said combustion chamber is positioned vertically above said heat exchanger whereby condensation formed in said heat exchanger is removed by gravity draining.

32. The heater according to claim 31, further comprising a collection box located at said flue gas outlet side of said heat exchanger to collect said flue gases and said condensation and direct said flue gases and said condensation to a waste outlet.

33. The air heater according to claim 27, further comprising a housing for surrounding and supporting said heat exchanger and having an air inlet and an air outlet.

34. The air heater according to claim 27, further comprising a blower for moving air through said housing and through said air passages of said heat exchanger.

35. An air heater, comprising:

a burner for burning a combustible fuel to provide flue gases;

a combustion chamber surrounding said burner;

a heat exchanger defining a plurality of flue gas passages and air passages and further defining an air inlet side, an air outlet side, a flue gas inlet side and a flue gas outlet side, wherein said combustion chamber communicates with such flue gas inlet side of said heat exchanger to direct said flue gases through said flue passages; and a comfort regulation control system having a first temperature sensor for monitoring room temperature at a working elevation and a second temperature sensor for monitoring room temperature at a second elevated elevation, said comfort regulation control system including:

a first control loop for switching said burner between an on condition and an off condition and for regulating the output of said burner between a preset minimum output and a preset maximum output;

a second control loop for switching said fan between an on condition and an off condition for regulating said fan between a low setting and a high setting; and a third anti-stratification control loop for switching said fan between said off condition and said low setting when said burner is in said off condition whereby both the heating of the room and anti-stratification of the air in the room is accomplished.

36. The air heater according to claim 35, wherein each of said control loops includes a hysteresis region to limit continuous cycling of said burner and said fan.

37. The heater according to claim 35, wherein said combustion chamber is positioned vertically above said heat exchanger whereby condensation formed in said heat exchanger is removed by gravity draining.

38. The heat according to claim 37, further comprising a collection box located at said flue gas outlet side of said heat exchanger to collect said flue gases and said condensation and direct said flue gases and said condensation to a waste outlet.

39. The air heater according to claim 35, further comprising a housing for surrounding and supporting said heat exchanger and having an air inlet and an air outlet.

40. The air heater according to claim 35, further comprising a blower for moving air through said housing and through said air passages of said heat exchanger.

41. An air heater, comprising:

a burner for burning a combustible fuel to provide flue gases;

a combustion chamber surrounding said burner;

a heat exchanger defining a plurality of flue gas passages and air passages and further defining an air inlet side, an air outlet side, a flue gas inlet side and a flue gas outlet side, and wherein said combustion chamber communicates with said flue gas inlet side of said heat exchanger to direct said flue gases through said flue passages;

at least one bypass channel which directs air flow across at least one surface of said combustion chamber to remove heat from said surface;

a plurality of heat shields; and wherein said heat exchanger includes an assembly of stacked corrugated plates, each of said plates includes opposing outer flanges about the periphery thereof; and wherein preselected flanges of said stacked corrugated plates are brazed together to define said alternating flue gas and air passage; and wherein said heat shields include an interior protective zone for surrounding said brazed flanges of said heat exchanger along said flue gas inlet side of said heat exchanger.

* * * * *